United States Patent [19]

Petrillo

[11] 4,008,573

[45] Feb. 22, 1977

[54] MOTIVE FLUIDS FOR EXTERNAL COMBUSTION ENGINES

[75] Inventor: Vincent Carmen Petrillo, Springfield, Pa.

[73] Assignee: General Electric Company, Fairfield, Conn.

[22] Filed: Dec. 9, 1975

[21] Appl. No.: 639,241

[52] U.S. Cl. ..... 60/651; 252/68
[51] Int. Cl.[2] ..... F01K 25/08
[58] Field of Search ..... 60/651, 671; 252/68

[56] References Cited

UNITED STATES PATENTS

| | | | |
|---|---|---|---|
| 3,722,211 | 3/1973 | Conner et al. | 60/671 X |
| 3,841,099 | 10/1974 | Somekh | 60/671 |
| 3,940,939 | 3/1976 | Davis | 60/671 X |

*Primary Examiner*—Allen M. Ostrager
*Attorney, Agent, or Firm*—Raymond H. Quist; Allen E. Amgott

[57] ABSTRACT

A motive fluid composed of ethyl alcohol, distilled water and one of several buffering agents such as pyridine is disclosed. The fluid is compatible with aluminum, ductile iron, and mild and carbon steels.

2 Claims, 1 Drawing Figure

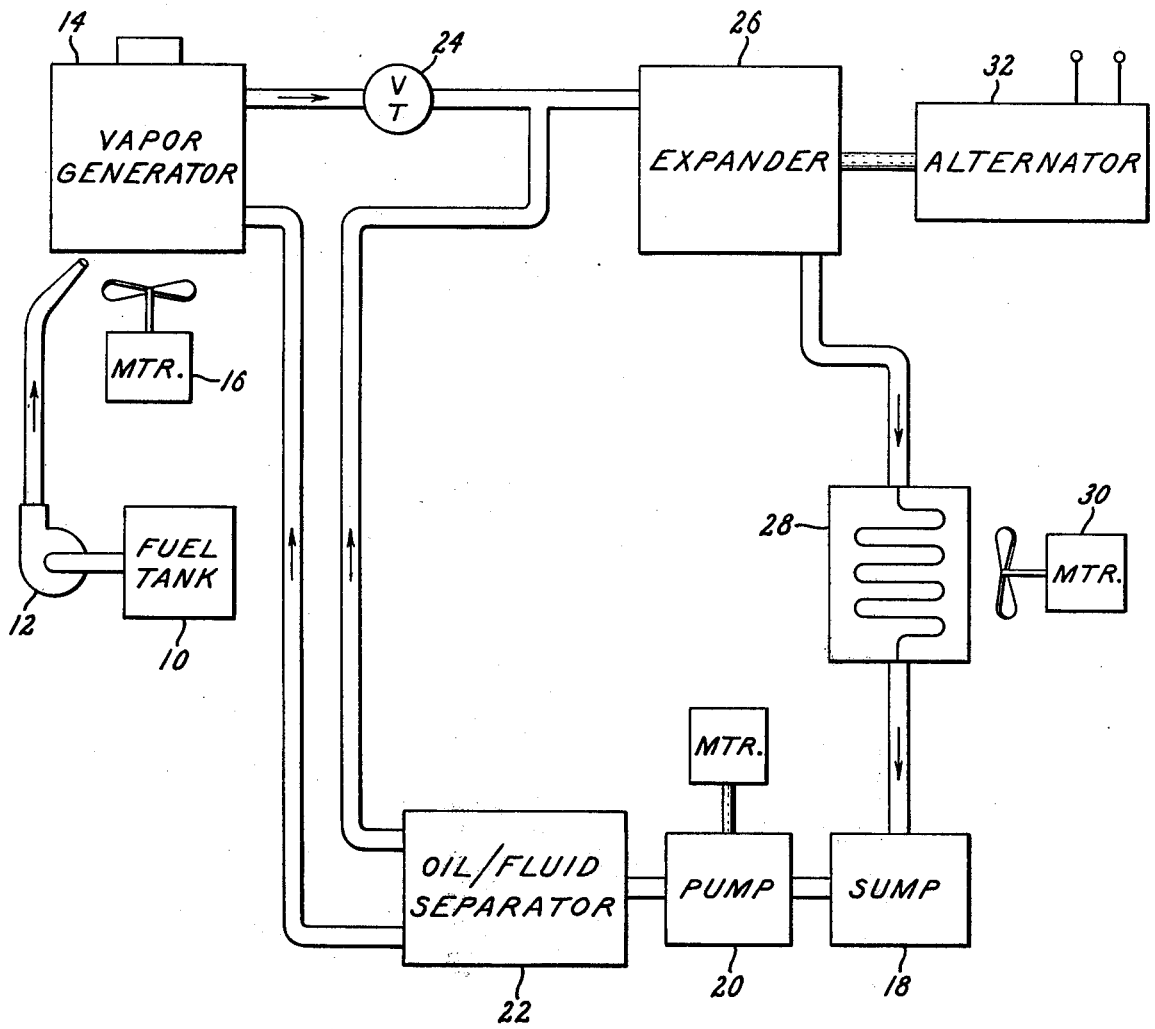
14
VAPOR GENERATOR
24
V
T
26
EXPANDER
32
ALTERNATOR
MTR.
16
FUEL TANK
12
10
28
30
MTR.
MTR.
OIL/FLUID SEPARATOR
PUMP
SUMP
22
20
18

MOTIVE FLUIDS FOR EXTERNAL COMBUSTION ENGINES

BACKGROUND OF THE INVENTION

This invention relates generally to motive fluids and more particularly to a motive fluid for an external combustion engine.

In designing and building an auxilliary power generating unit of the external combustion type, an important consideration was a suitable motive fluid. Such a unit is not designed for continuous operation and may be kept outdoors, hence the fluid should not freeze at expected winter temperatures. It must also be compatible with the materials with which it comes in contact. In the power unit built, ductile iron and carbon steel which are susceptible to corrosion if an acidic fluid is used, and aluminum which is attacked by highly alkaline fluids, were employed.

Additionally, the fluid should not readily decompose at the operating temperatures involved, should have as high a molecular weight as possible, should not be excessively dangerous and should be reasonably priced.

It should be noted that the prior art is replete with candidate working fluids, for example U.S. Pat. No. 3,516,248 includes pyridine and ethanol (see column 4, lines 2 and 6 respectively). In the research performed which led to this invention, however, it was found that such fluids would not satisfy the requirements given above.

SUMMARY OF THE INVENTION

Approximately equal parts of 190 proof ethyl alcohol and distilled water to which a buffering agent is added may be used as a motive fluid in an external combustion engine. Suitable buffering agents are: pyridine, ethylenediamine, Nalco 352, Nalco 356 and Alox 1843.

BRIEF DESCRIPTION OF THE DRAWING

The drawing is a schematic of an external combustion engine system.

DESCRIPTION OF THE PREFERRED EMBODIMENT

In the drawing is shown a system in which the fluids of this invention may be employed. Fuel from fuel tank 10 is pumped by fuel pump 12 to vapor generator 14. Blower 16 supplies the required air. Vapor generator 14 may be of any desired type. Motive fluid from sump 18 is pumped by feed pump 20 through oil/fluid separator 22 to vapor generator 14. The vaporized fluid passes through throttle valve 24 to be combined with lubricating oil before entering expander 26. The expanded fluid is condensed in condenser 28 having flower 30 for providing the cooling air. Expander 26 drives alternator 32.

In this system, expander 26 is made of ductile iron, while condenser 28 is of aluminum, and oil/fluid separator housing 22 and sump 18 are of carbon steel.

The composition of the motive fluid of this invention is given in TABLE I.

In lieu of the pure ethyl alcohol, a pyridine-based, specially denatured alcohol identified by the Treasury Department as SDA 6B, may be substituted.

Alternatives to pyridine have also been tested and found somewhat satisfactory, specifically organic amines such as the following in the amounts indicated yield a mixture having a pH in the desired range (from 7 to 8.5):

Nalco 352: 0.01%
Nalco 356: 0.01%
Alox 1843: 3%

These are products of Nalco Chemical Company and Alox Corporation respectively. There are indications that some derivatives of pyridine and pyridine related compounds (such as homologues of pyridine) may also be used in lieu of pyridine.

In addition, ethylenediamine in an amount of 5 ppm provides a pH of about 8.4; however, other amine type compounds appear likely candidates.

While particular embodiments of motive fluids have been described, changes and modifications can be made without departing from the spirit of the invention and the scope of the appended claims.

TABLE 1

MOTIVE FLUID COMPOSITION

| Ingredient | Specification | Parts by Volume |
|---|---|---|
| 1. Ethyl Alcohol, Pure, 190° Proof* | U.S.P. or A.C.S. Reagent Chemicals | 45.0 – 45.5 |
| 2. Distilled Water | ASTM D1193-72, TY.II | 45.0 – 45.5 |
| 3. Pyridine | A.C.S. Reagent Chemicals | 9.0 – 9.2 |

*or S.D.A. 6-B, 190 Proof, per U.S. Treasury Dept. IRS Publication No. 368.

I claim:

1. A method of converting heat energy to mechanical energy comprising:

vaporizing a fluid by passing it in heat exchange relationship with a heat source, said fluid comprising in parts by volume:

ethyl alcohol: 45 to 45.5%
distilled water: 45 to 45.5%
pyridine: 9 to 10% utilizing the energy of the vaporized fluid to perform work.

2. A method of converting heat energy to mechanical energy comprising:

vaporizing a fluid by passing it in heat exchange relationship with a heat source, said fluid comprising:

ethyl alcohol
distilled water, and a buffering agent from the group consisting of:

pyridine and its homologues
ethylenediamine and other amine type compounds utilizing the energy of the vaporized fluid to perform work.

* * * * *